US011025036B2

(12) United States Patent
Lindemulder

(10) Patent No.: US 11,025,036 B2
(45) Date of Patent: Jun. 1, 2021

(54) HOT STICK QUICK CONNECT SURGE ARRESTER ASSEMBLY

(71) Applicant: Paul Lindemulder, Saint John, IN (US)

(72) Inventor: Paul Lindemulder, Saint John, IN (US)

( * ) Notice: Subject to any disclaimer, the term of this patent is extended or adjusted under 35 U.S.C. 154(b) by 99 days.

(21) Appl. No.: 16/298,679

(22) Filed: Mar. 11, 2019

(65) Prior Publication Data

US 2019/0280463 A1 Sep. 12, 2019

(51) Int. Cl.
*H01T 1/14* (2006.01)
*H01T 4/08* (2006.01)
*H01C 7/12* (2006.01)

(52) U.S. Cl.
CPC ..... *H01T 1/14* (2013.01); *H01T 4/08* (2013.01); *H01C 7/126* (2013.01)

(58) Field of Classification Search
CPC .... H01T 1/14; H01T 4/08; H01T 4/16; H02G 13/00; H01C 7/12; H01C 7/102; H01C 7/126
USPC ..... 361/117, 118, 125, 127
See application file for complete search history.

(56) References Cited

U.S. PATENT DOCUMENTS 3,035,209 A * 5/1962 Smith, Jr. ..... H01B 3/46 361/39
4,282,557 A * 8/1981 Stetson ..... H01T 1/15 361/117
5,057,810 A 10/1991 Raudabaugh
5,113,167 A 5/1992 Raudabaugh
5,400,207 A * 3/1995 Krause ..... H01T 1/14 361/117
5,991,141 A * 11/1999 Mikli ..... H01C 7/12 361/127
7,656,639 B2 2/2010 Woodworth et al.
8,638,537 B2 1/2014 Kester et al.
9,407,088 B2 8/2016 Sulitze
9,438,024 B2 9/2016 Ramarge et al.
9,543,745 B2 1/2017 Ramarge et al.
9,755,420 B2 9/2017 Smith
9,793,701 B2 10/2017 Springborn
10,454,262 B2 * 10/2019 Niles ..... H01B 17/00
2008/0068122 A1 3/2008 Lenk et al.
2012/0086541 A1 4/2012 Kester
2017/0301438 A1 10/2017 Robben et al.

FOREIGN PATENT DOCUMENTS

GB 2328567 A * 2/1999 ..... H01C 7/12

* cited by examiner

*Primary Examiner* — Yemane Mehari
(74) *Attorney, Agent, or Firm* — Scherrer Patent & Trademark Law, P.C.; Stephen T. Scherrer; Monique A. Morneault

(57) ABSTRACT

A surge arrester assembly comprises a ground connector with a clamping component and line connector assembly that incorporates non-bolted mechanical and electrical connections. The assembly connections permit the use of insulating hot sticks for installation and removal of the arrester module for safe and rapid removal and replacement of expired surge arresters. The clamp and line connector are reusable for replacement of surge arresters.

19 Claims, 3 Drawing Sheets

HOT STICK QUICK CONNECT SURGE ARRESTER ASSEMBLY

The present invention claims priority to U.S. Provisional Pat. App. No. 62/641,967, titled "Hot Stick Quick Connect Surge Arrester Assembly," filed Mar. 12, 2018, which is incorporated by reference herein in its entirety.

TECHNICAL FIELD

The present disclosure relates to an assembly of a surge arrester, quick connecting power and ground connections and an isolator to protect power distribution and transmission lines from surges such as lightning and switching surges. Specifically, the present invention provides a means to mechanically and electrically connect a surge arrester in way that allows quick replacement of expired arresters safely with the use of hot stick devices and without replacing bolted connections.

BACKGROUND

Surge arresters are typically used on power distribution and transmission circuits to protect the connected equipment and insulation systems from electrical surges, typically from lightning strikes or equipment switching events, by redirecting surges to ground through the surge arrester. The surge arrester utilizes metal oxide varistor (MOV) technology that instantaneously senses electrical surges and provides a very low resistance path to ground thereby reducing the voltage spike associated with the surge and thus protecting the nearby equipment. However, excessive surges, internal breakdown of the MOV system, or over time repeated surges, can cause the arrester to short circuit. The surge arrester typically contains an isolator, or disconnector, device that separates the surge arrester from the circuit physically and electrically, allowing the upstream fusing, or breaker equipment, to interrupt the fault current and restore the system to normal operation. The operation of the isolator also provides a visual indication that the surge arrester is no longer protecting the circuit and needs to be replaced. Typical isolators are disclosed in U.S. Pat. Nos. 5,057,810 and 5,113,167 to Raudabaugh, U.S. Pat. No. 5,400,207 to Krause and U.S. Pat. No. 8,638,537 to Kester.

Conventionally, the isolator will separate either the surge arrester's line (voltage) connection or ground potential connection. Once this occurs, the arrester must be replaced. The arrester is typically mounted to a bracket using nuts and bolts, or may be hung from the line connection. Both the line and ground connections are also made using nuts and bolts or special line clamps that use an integrated bolt. To replace the surge arrester with a new surge arrester, one must remove all the bolted connections and install the new arrester with new bolted connections. This is typically done by deenergizing the circuit leaving the customer without power, or it is done using hot line work practices using specialized insulating protective gear and tools from an insulated bucket truck.

SUMMARY OF THE INVENTION

The present disclosure provides a surge arrester with non-bolted quick connections for the mechanical mounting, line and ground connections. Specifically, the surge arrester quick connections provide a means to use a standard lineman's hot stick tool to disconnect an expired arrester line and ground connections, physically remove the expired surge arrester and then install a new surge arrester, reconnect the line and ground connections without using typical wrenches to bolt these connections.

Further the invention provides a means to combine the mechanical mounting connection with the ground connection, eliminating the need for an insulating bracket for those applications where the isolator is between the surge arrester unit and the ground connection. This reduces costs and eliminates the potential for insulated bracket tracking and potentially a secondary fault with the arrester.

Further the invention provides a spring-loaded line connection and isolator assembly to provide a positive separation with the line connection to prevent loose wires from the isolator operation accidentally reconnecting the expired surge arrester into the circuit.

It is, therefore, an advantage and objective of the present invention to provide an improved surge arrester design to more safely replace an expired arrester using energized hot line practices for the protection of utility linemen against accidental electrocution during surge arrester replacement.

In addition, it is an advantage and objective of the present invention to provide an improved surge arrester design to more quickly replace an expired arrester without deenergizing the line and removing service to power customers while replacing the arrester.

In addition, it is an advantage and objective of the present invention to provide an improved surge arrester design that reduces the cost of replacing expired surge arresters by eliminating the insulating bracket typically used in the surge arrester and by reusing the bolted portions of the assembly.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present disclosure provides a quick connect surge arrester using hot stick apparatus. Specifically, the quick connect surge arrester comprises a reusable lower clamping bracket that acts as both mechanical and electrical connection, a ground connector base, an arrester module, a spring loaded upper quick connector with isolator and a top reusable v-shaped connector. The arrester quick connection provides the means to install, remove and replace the arrester module with the use of utility issued hot sticks and without removing bolted connections.

Figure 1:
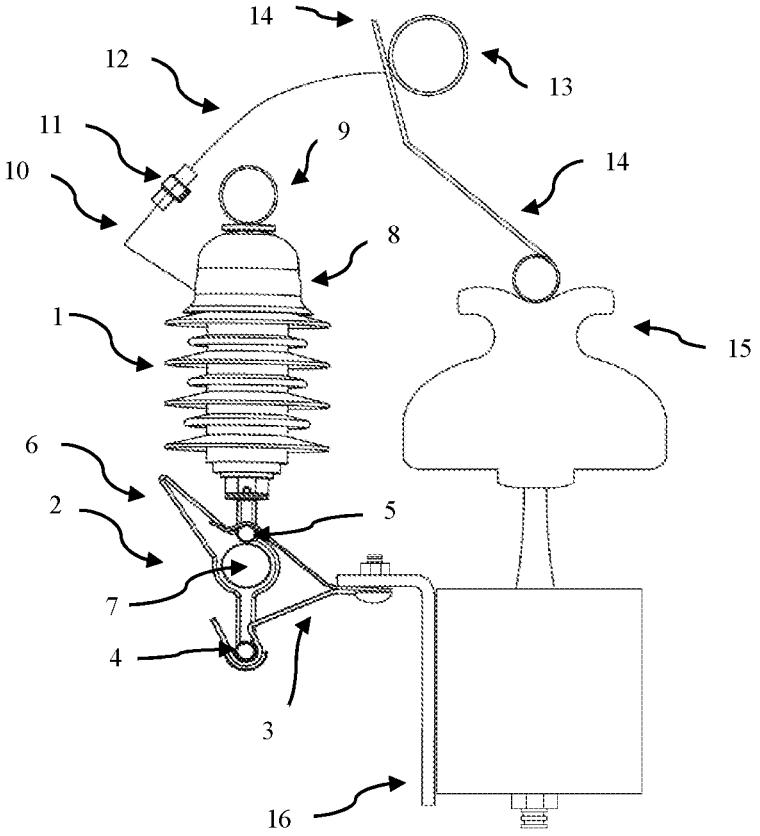
FIG. 1 illustrates the quick connect surge arrester in a typical application for protecting power line insulators.
Figure 2:
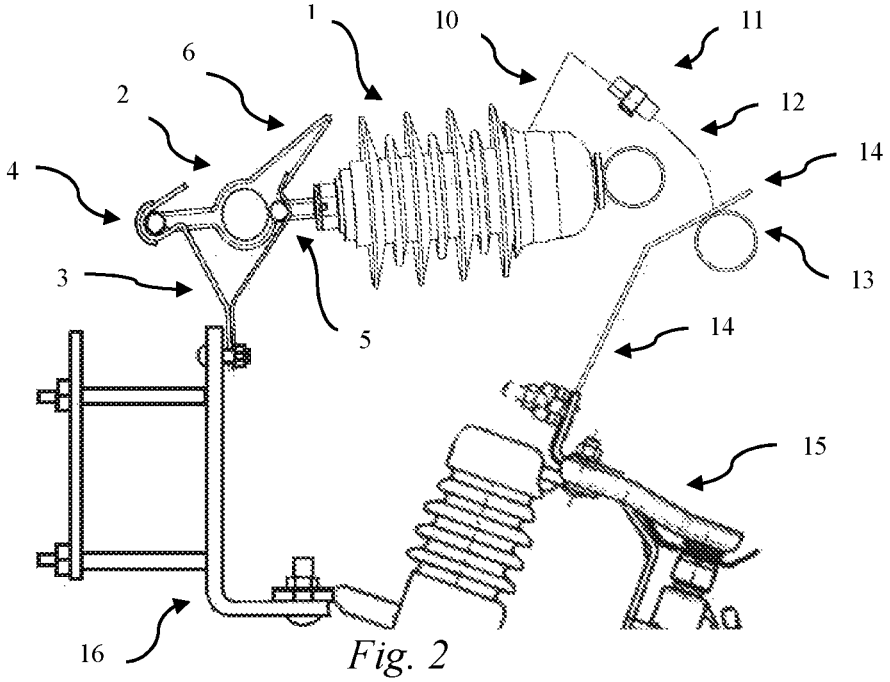
FIG. 2 illustrates the quick connect surge arrester in a typical application for protecting power system fused cutouts.
Figure 3:
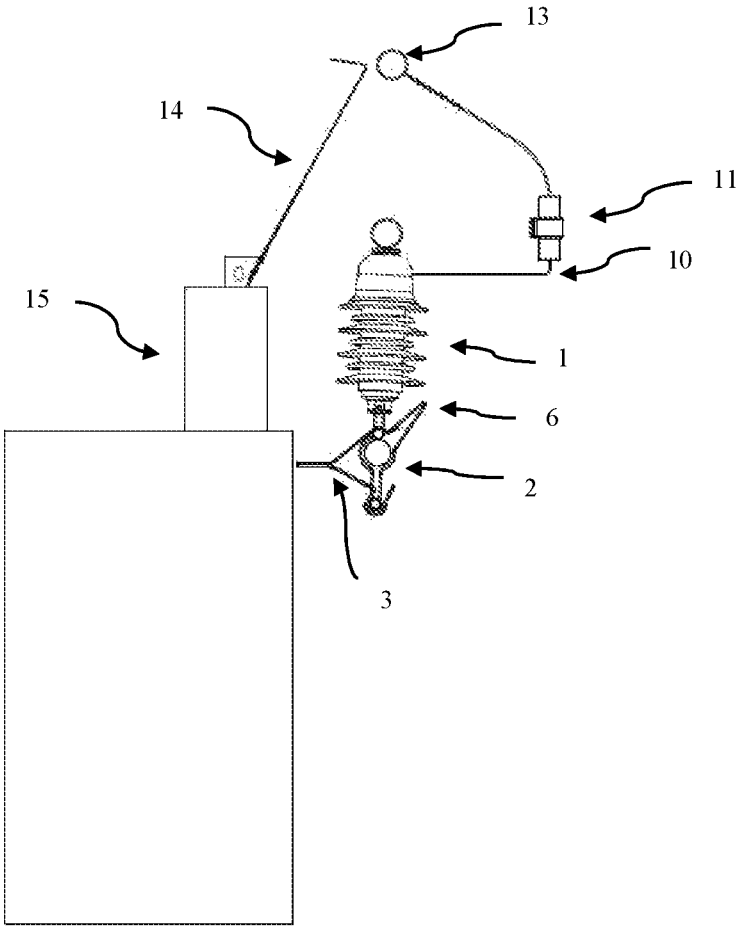
FIG. 3 illustrates the quick connect surge arrester in a typical application for protecting power system transformers.

Now referring to the figures, wherein like numerals refer to like parts, FIG. 1 illustrates a side view of surge arrester unit in the fully installed position. The arrester module 1 is connected to the ground (earth) connector 2. The ground connector 2 as installed is held in place with the ground clamp 3 which is mounted to the power equipment to be protected 15 or equipment mounting bracket 16. The spring tension of the ground clamp provides both the mechanical support for the surge arrester and the electrical connection for ground such that the surge arrester can be replaced with a new arrester into the same, reusable, clamp.

The arrester module 1 is also connected to the line spring loaded connector 10, the isolator 11, or alternatively a fuse module, and line side hot stick loop 13 all in series. The line side hot stick loop 13 as installed is connected to the line side equipment v-shaped connector 14 and held in place by the tension of the spring-loaded connector 10. At the end of life of the surge arrester, the isolator 11 will separate the line side loop connector 13 from the line spring-loaded connector 10 to indicate the arrester needs to be replaced. The hot stick loop 13 and the arrester unit can then be replaced using a hot stick without bolted connections.

The ground connector 2 contains three features for functionality of the mechanical and electrical connections. The connector embodies an upper 5 and lower 4 pins that mate with the clamp 3 for the mechanical and electrical connection. The center of the connector embodies a loop 7 for use with the hot stick pin to raise and lower the surge arrester into and out of the lower portion of the clamp by hanging the surge arrester in an inverted position on the hot stick. The ground connector also embodies an arc tip 6 to be the electrical arc termination point during the end of life event, which causes external arcing from the venting of fault current in the arrester module. The arc tip 6 protects the lower clamp 3 from arc damage during this end of life event.

Figure 6:
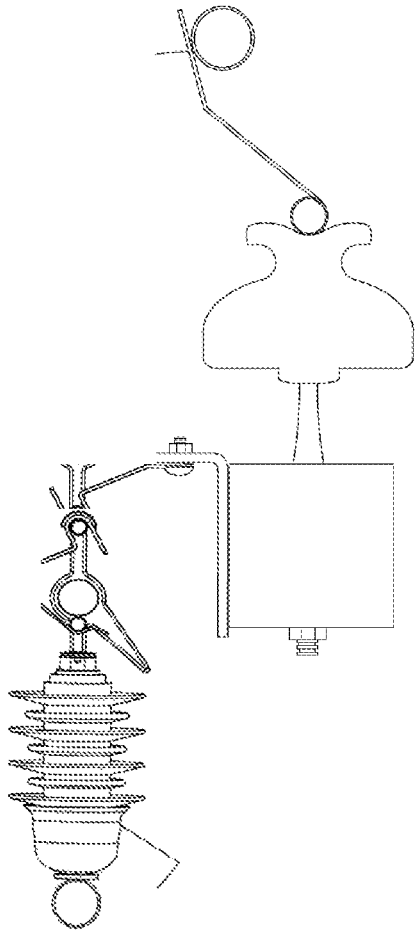
FIG. 6 illustrates the quick connect surge arrester in the installation and post end of life position.

The surge arrester embodies a top insulating cover 8 that includes an insulating top eyelet 9 connected to the arrester module. The eyelet 9 is used to install and remove a surge arrester using a hot stick pin in the eyelet to swing the inverted arrester, as it rests in the lower clamp 3, into the installed position and locked into place in the clamp via the pins 4 and 5 as shown in FIGS. 1 and 6. The removal is performed by the reverse operation by pulling down with a hot stick pin in the eyelet 9.

Figure 4:
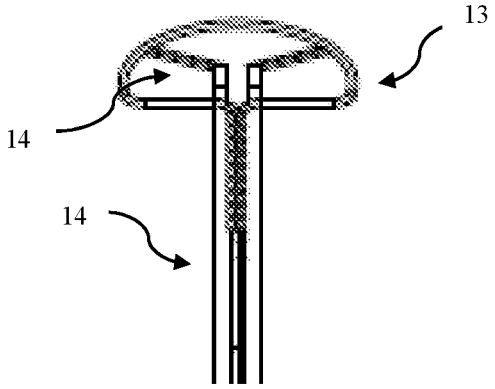
FIG. 4 illustrates the quick connect surge arrester line side hot stick removable connection loop as depicted in FIGS. 1, 2 and 3.
Figure 5:
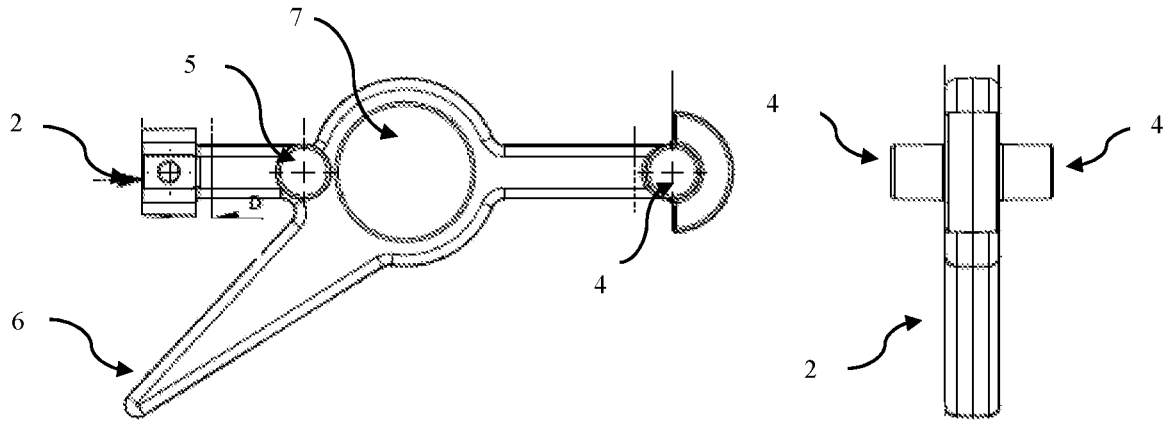
FIG. 5 illustrates the quick connect surge arrester ground/earth mounting/connector apparatus as depicted in FIGS. 1, 2 and 3.

The surge arrester embodies a top line connection assembly that embodies a spring-loaded connector 10 that is connected to the arrester module via a bolted connection under the insulating cap 8 on one end and connected to the isolator 11 on the other end. The isolator is connected to the hot stick loop 13 via a wire or cable 12 connected to the isolator. The assembly is mechanically and electrically connected to v-shaped connector 14 by using a hot stick placed in the loop 13 and pulling the assembly into the v-shaped connector 14. The spring action of the assembly will pull down the loop into position and hold it as the electrical connection to the connector as shown in FIG. 4. The v-shaped connector is bolted to the equipment 15 and remains as a reusable connection for the replacement arrester.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are non-limiting, and it should be noted that claim limitations presented herein are not meant to describe the invention as a whole. Moreover, the invention illustratively disclosed herein suitably may be practiced in the absence of any element which is not specifically disclosed herein.

I claim:

1. A quick connect surge arrester assembly comprising:
an arrester module (1);
a reusable lower clamping bracket (3) that acts as both mechanical and electrical connection;
a ground connector base (2); and
a spring loaded upper quick connector (10) connected to the arrester module, the spring loaded upper quick connector connected in series to an isolator (11) or a fuse module, the isolator or fuse module connected in series to a cable (12), the cable (12) connected in series to a hot stick loop (13), the hot stick loop (13) connected in series to a top reusable v-shaped connector (14).

2. The surge arrester assembly of claim 1 wherein the arrester module is connected to the ground connector base (2) containing pins (4 & 5) for mating with the lower clamping bracket (3).

3. The surge arrester assembly of claim 1 wherein the ground connector base contains a loop (7) for lifting the surge arrester assembly.

4. The surge arrester assembly of claim 1 wherein the ground connector base comprises an arc tip (6) configured to be the electrical arc termination point for protecting the clamp from arc damage.

5. The surge arrester assembly of claim 1 wherein the spring-loaded upper quick connector provides a mechanical and electrical connection that is configured to separate providing an electrical open circuit and provide a visual indication of arrester end of life needing to be replaced.

6. The surge arrester assembly of claim 1 wherein the hot stick loop (13) provides a non-bolted replaceable connection to the v-shaped line connector (14).

7. The surge arrester assembly of claim 1 wherein the v-shaped connector (14) is a reusable connector that is bolted to equipment being protected and is configured to contain the hot stick loop (13).

8. The surge arrester assembly of claim 1 wherein the arrester module is connected to an insulating cover (8) and an insulating eyelet (9) to provide a hot stick means to install the arrester.

9. The surge arrester assembly of claim 1 wherein the arrester module is connected to the ground connector base (2) and the ground connector base is mounted into the lower clamping bracket (3), wherein the lower clamping bracket (3) is mounted to equipment to be protected.

10. The surge arrester assembly of claim 1 wherein the lower clamping bracket (3) is reusable for use with a second surge arrester assembly (1).

11. The surge arrester assembly of claim 1 wherein the ground connector base contains a loop (7) for lifting the surge arrester assembly.

12. A surge arrester assembly comprising:
an arrester module (1);
a spring loaded upper quick connector (10);
an isolator (11) or a fuse module;
a cable (12);
a hot stick loop (13);
a top reusable v-shaped connector (14);

a reusable lower clamping bracket (3) that acts as both a mechanical and electrical connection;

a ground connector base (2) connected between the arrester module and the lower clamping bracket (3) comprising a v-shaped arc tip (6); and a spring loaded upper quick connector (10) connected to the arrester module, wherein the hot stick loop (13) provides a non-bolted replaceable connection to the v-shaped line connector (14).

13. The surge arrester assembly of claim 12 wherein the arc tip (6) is disposed on a side of the ground connector base (2) that is opposite the lower clamping bracket (3).

14. The surge arrester assembly of claim 12 wherein the ground connector base (2) comprises a plurality of pins (4 & 5) for mating with the lower clamping bracket (3).

15. The surge arrester assembly of claim 14 wherein the ground connector base (2) comprises a lower pin (4) connected to the lower clamping bracket (3) and an upper pin (5) connected to the lower clamping bracket (3).

16. The surge arrester assembly of claim 12, wherein the spring loaded upper quick connecter (10), the isolator (11) or fuse module, the cable (12), the hot stick loop (13) and the top reusable v-shaped connected (14) are connected in series to the arrester module.

17. The surge arrester assembly of claim 12 wherein the spring-loaded upper quick connector provides a mechanical and electrical connection that is configured to separate providing an electrical open circuit and provide a visual indication of arrester end of life needing to be replaced.

18. The surge arrester assembly of claim 12 wherein the v-shaped connector (14) is a reusable connector that is bolted to equipment being protected and is configured to contain the hot stick loop (13).

19. A surge arrester assembly comprising:

an arrester module (1);

a spring loaded upper quick connector (10);

an isolator (11) or a fuse module;

a cable (12);

a hot stick loop (13);

a top reusable v-shaped connector (14);

a reusable lower clamping bracket (3) that acts as both a mechanical and electrical connection;

a ground connector base (2) connected between the arrester module and the lower clamping bracket (3) comprising a v-shaped arc tip (6); and a spring loaded upper quick connector (10) connected to the arrester module, wherein the v-shaped connector (14) is a reusable connector that is bolted to equipment being protected and is configured to contain the hot stick loop (13).

* * * * *